US006745953B2

(12) United States Patent
Boecking

(10) Patent No.: US 6,745,953 B2
(45) Date of Patent: Jun. 8, 2004

(54) PRESSURE-CONTROLLED COMMON RAIL FUEL INJECTOR WITH GRADUATED OPENING AND CLOSING BEHAVIOR

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 143 days.

(21) Appl. No.: 10/004,792

(22) Filed: Dec. 7, 2001

(65) Prior Publication Data

US 2002/0084347 A1 Jul. 4, 2002

(30) Foreign Application Priority Data

Dec. 7, 2000 (DE) ..... 100 60 836

(51) Int. Cl.[7] ..... F02M 47/02; F02M 39/00; B05B 1/30

(52) U.S. Cl. ..... 239/96; 239/88; 239/89; 239/91; 239/533.3; 239/585.5

(58) Field of Search ..... 239/88, 89, 90, 239/91, 95, 96, 533.2, 533.3, 533.4, 533.8, 533.9, 585.1, 585.3, 585.4, 585.5; 251/129.15, 129.21, 127

(56) References Cited

U.S. PATENT DOCUMENTS

| | | | | | |
|---|---|---|---|---|---|
| 4,185,779 | A | * | 1/1980 | Watson | 239/533.3 |
| 4,296,911 | A | * | 10/1981 | Escobosa | 251/57 |
| 4,418,671 | A | * | 12/1983 | Kelso et al. | 123/450 |
| 4,449,503 | A | * | 5/1984 | Luscomb | 123/447 |
| 4,462,372 | A | * | 7/1984 | Jackson | 123/452 |

* cited by examiner

*Primary Examiner*—Davis Hwu
(74) *Attorney, Agent, or Firm*—Ronald E. Greigg

(57) ABSTRACT

An injector for injecting fuel, which is at high pressure, into the combustion chamber of an internal combustion engine includes valve body movably received in an injector housing, and a slide region is embodied on it. The valve body further includes a seat diameter, which cooperates with a seat face embodied on the housing and by way of which a nozzle inlet to a nozzle chamber of an injection nozzle can be opened and closed. The valve body is embodied as a 3/3-way control valve, by way of whose slide region a control chamber that varies the stroke of a nozzle needle can be controlled.

11 Claims, 2 Drawing Sheets

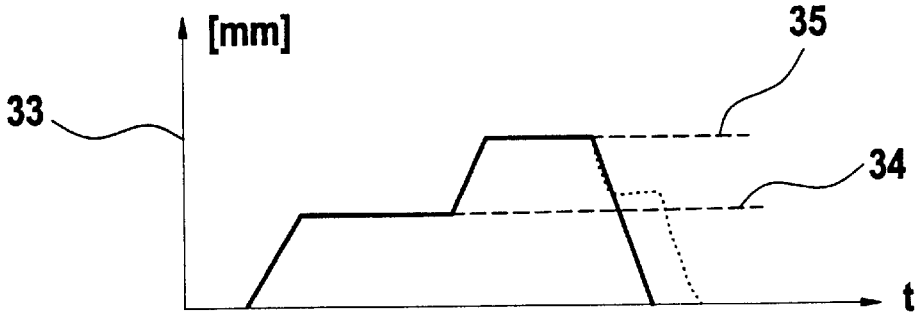
Fig. 2.1
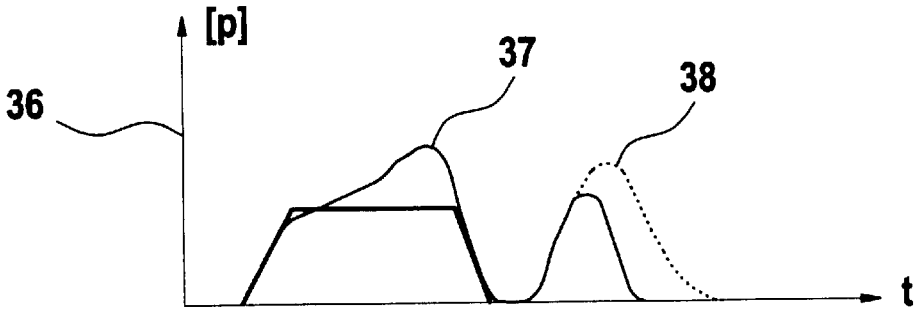
Fig. 2.2
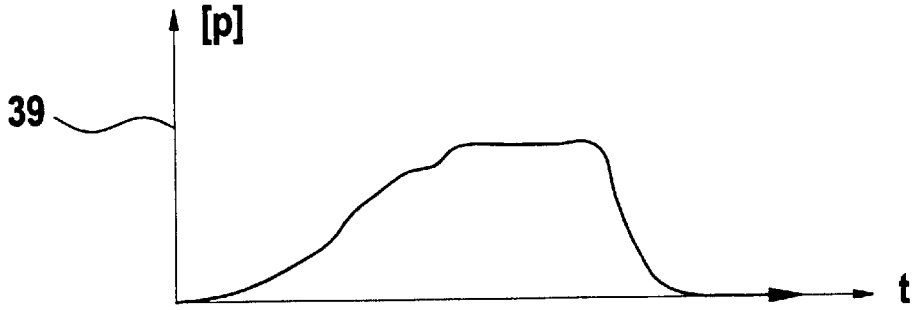
Fig. 2.3

PRESSURE-CONTROLLED COMMON RAIL FUEL INJECTOR WITH GRADUATED OPENING AND CLOSING BEHAVIOR

BACKGROUND AND FIELD OF THE INVENTION

Along with other demands made of an ideal injection behavior is the demand for independent definition of the injection pressure and injection quantity, which should both be freely selectable for any operating point in which an internal combustion engine can be operated. This provides one additional degree of freedom in terms of the mixture formation. In addition, at the onset of injection the injection quantity should be as slight as possible, to compensate for the resultant ignition lag between the onset of injection and the onset of combustion. Both demands are met by fuel injection systems with a high-pressure collection chamber (common rail), by way of which the individual injectors are supplied with fuel that is at extremely high pressure for the combustion chambers of the engine.

DESCRIPTION OF THE PRIOR ART

European Patent Disclosure EP 0 657 642 A2 relates to a fuel injection system for internal combustion engines. It includes a high-pressure collection chamber, which can be filled by a high-pressure pump and from which high-pressure lines lead away to the individual injection valves. In the individual high-pressure lines, control valves are provided for controlling the high-pressure injection at the injection valves, along with an additional pressure reservoir between these control valves and the high-pressure collection chamber (common rail). To prevent the high system pressure here from being applied constantly to the injection valves, the control valve is embodied such that during the intervals between injections, it closes its communication at the injection valve with the pressure reservoir and opens a communication between the injection valve and a relief chamber.

From U.S. Pat. No. 5,628,293, an electronically controlled fluid injector is known, with which a fluid collection chamber that can be acted upon by a preinjection and with directly triggerable control elements to open the connecting line between the fluid collection chamber and the injection nozzle that protrudes into the combustion chamber of an internal combustion engine. Besides the first, directly triggerable injection element, a further pressure control element is movable back and forth between two control positions. By means of the two switchable pressure control elements, hydraulic forces acting counter to one another can be balanced. In this configuration, the fact that controlling the pressure elements is done via two units, which when the control device is selected are secured only partly against a resultant overpressure or a resultant excess quantity of fuel, is a disadvantage.

OBJECT AND SUMMARY OF THE INVENTION

With the injector configuration according to the invention, an opening that takes place in preselectable stages and a graduated closure of the nozzle needle of an injector are brought about. To attain a main injection into the combustion chamber of a direct-injection internal combustion engine, and to perform a postinjection into the combustion chamber, the injector needs to be triggered only a single time, which in terms of the electrical power means a 50% savings in electrical energy. Along with a 50% savings of electrical energy for triggering the injector, the switching forces can be minimized by choosing the same diameter for the guide diameter and the seat diameter, since in that case the valve body is force-balanced.

By the design of the throttles on the outlet and inlet sides of the control chamber for a nozzle needle, the injector can be properly designed. If a parallel change in both throttle restrictions takes place, the fuel volume throughput remains the same upon adaptation of the control valve. With the proposal according to the invention, a pressure-controlled injector is created whose valve chamber, surrounding the valve body, communicates with a control chamber that can act upon the nozzle needle. At the same time, this control chamber communicates on the inlet side with the supply to the nozzle chamber via a throttle element. This configuration opens up the possibility, by partial pressure relief of the control chamber acting on the nozzle needle, of moving the nozzle needle in graduated fashion, that is, to impose partial stroke lengths on it, so that an optimal injection characteristic, for instance for utility vehicle engines, can be attained.

Along with the possibility of establishing a graduated vertical motion and thus an injection characteristic that is especially well suited to applications in utility vehicles, the proposed pressure-/stroke-controlled injector is especially simple in construction and therefore can be produced economically.

BRIEF DESCRIPTION OF THE DRAWINGS

The invention will be better understood and further objects and advantages thereof will become more apparent from the ensuing detailed description of preferred embodiments taken in conjunction with the drawings, in which:

FIG. 2.1 graphically shows the stroke level of the valve body;

FIG. 2.2 shows the pressure course at the injection opening, plotted over the injection phases; and FIG. 2.3 shows the pressure course above the seat of the valve body.

DESCRIPTION OF THE PREFERRED EMBODIMENTS

Figure 1:
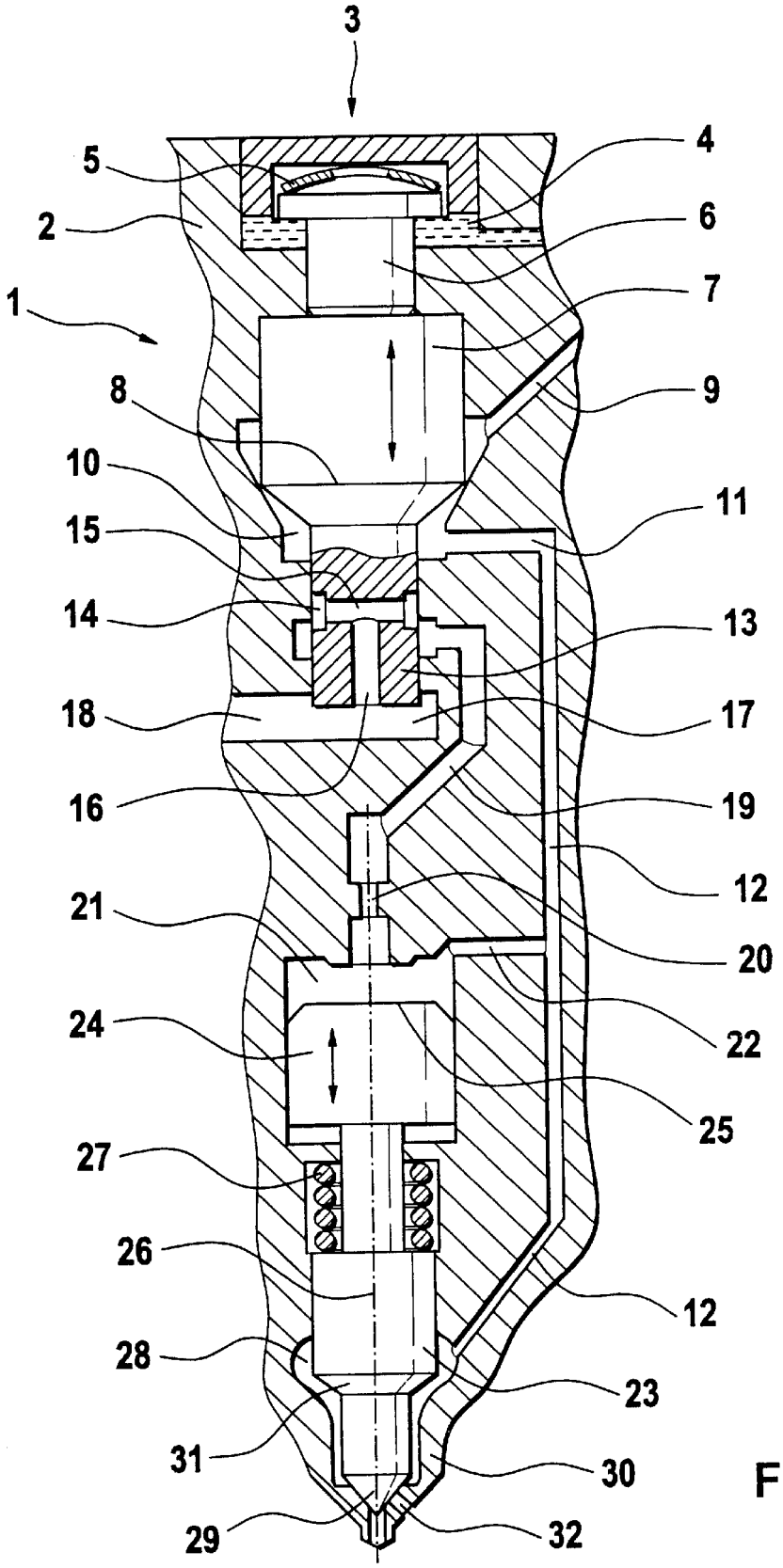
FIG. 1 shows a longitudinal section through the injector, configured according to the invention, with graduated vertical stroke motion of the nozzle needle.

In the view of FIG. 1, the cross section through an injector configured according to the invention with graduated vertical motion of the nozzle needle is seen in more detail.

The injector in FIG. 1 includes a valve body 7, guided vertically in the injector housing 2, of a 3/3-way control valve, as well as a nozzle needle 23, likewise vertically guided in the injector housing 2.

The vertical stroke motion of the valve body 7 is brought about via an actuator 3, which can be embodied as a piezoelectric actuator or as a magnet valve. The actuator 3 is assigned a hydraulic booster 4. The actuator 3 is assigned a piston element 6, which on its upper end face surrounds a spring element 5 that creates prestressing. In the view of FIG. 1, this spring element is embodied as a cup spring. The lower end face of the piston 6 rests on the upper end face of the valve body 7, which functions as a 3/3-way control valve.

The valve body 7, with its guide region in which it is surrounded by the injector housing 2, is embodied with a diameter that is equivalent to the seat diameter 8. With the seat diameter 8, in the closed state, the valve body 7 closes a seat face inside a valve chamber 10, into which an inlet 9 from the high-pressure collection chamber (common rail) discharges. An outlet line 11 branches off from the valve chamber 10 inside the injector housing 2 and merges with a nozzle inlet 12, which discharges in the region of the nozzle needle 23 into a nozzle chamber 28 surrounding the nozzle needle. Branching off from the nozzle inlet 12 is a supply line for a control chamber 21, and an inlet throttle 22 is received in the supply line.

Below the seat diameter 8, the valve body 7 is embodied with a conical transitional region, which changes into a slide region 13 on the valve body 7. Embodied inside the slide region 13 is a transverse bore 15, which communicates with a bore 16 extending longitudinally in the slide region 13. With its lower end face, the valve body 7 dips into a leaking oil chamber 17 provided on the side toward the leaking oil; this chamber, via a leaking oil line 18, communicates for instance with the fuel reservoir, so that fuel can be caught by way of it. Depending on the desired vertical stroke of the valve body 7 by means of the triggering of the actuator 3, the transverse bore 15 inside the slide region 13 of the valve body 7 is in complete or partial overlap with a control edge 14. An outlet 19, in which an outlet throttle 20 is received, discharges in the slide region 13 of the valve body, and by way of this outlet throttle, the control chamber 21 can be pressure-relieved; as already noted, this chamber can be acted upon via the supply line from the nozzle inlet 12 by fuel that is at high pressure.

A piston element 24 is received in the control chamber 21 and with a peglike extension acts on the upper face end of the nozzle needle 23. The control chamber 21 inside the injector housing 2 is defined by the wall of the injector housing 2 on one side and by the upper face end 25 of the piston 24. Upon pressure relief of the control chamber 21, or if pressure is exerted on it via the supply line 22 that branches off from the nozzle inlet 12, the piston 24 moves up or down, in accordance with the resultant pressure level in the control chamber 21. A spring element 27 acting as a closing spring is received on the peg that is embodied below the head region of the piston 24, and with this spring element the opening pressure of the nozzle needle 23 acted upon by the piston element 24 can be adjusted. The control chamber 21, piston 24 and nozzle needle 23 are embodied symmetrically to the axis 26 of symmetry. A pressure shoulder 31 is embodied on the nozzle needle 23 in the region of the nozzle chamber 28. In the exemplary embodiment shown here, the nozzle chamber 28 extends as far as the seat face of the nozzle needle tip 29, which in the state shown closes an injection opening 32. The injection opening 32 is embodied in the wall 30 of the injector housing 2.

The mode of operation of the injector configured according to the invention is as follows:

If the actuator 3, for instance embodied as a piezoelectric actuator, is triggered, the valve body 7 moves upward in the injector housing 2, so that the seat, closed by the seat diameter 8 in cooperate with a seat face disposed on the valve chamber 10, is opened and fuel that is at high pressure can flow from the high-pressure collection chamber (common rail) into the valve chamber 10 via the inlet 9. The fuel volume enclosed in the valve chamber 10 flows via the outlet line 11 into the nozzle inlet 12 and via the nozzle inlet 12 into the nozzle chamber 28 and is present there. By means of the pressure shoulder 31 embodied on the nozzle needle 23 in the region of the nozzle chamber, the nozzle needle 23 is acted upon by an opening force, acting in the direction of the control chamber 21, which is counteracted by the closing force exerted by the closing spring 27 and by the pressure force prevailing in the control chamber 21 at the time. Parallel to the subjection of the nozzle chamber 28 to fuel at high pressure via the nozzle inlet 12, an imposition of pressure on the control chamber 21 is effected through the supply line 22. The control chamber 21, via its outlet line 19, in which an outlet throttle 20 can be provided, is controlled via the position of the slide region 13 on the valve body 7. Depending on the extent to which the piezoelectric actuator is triggered, that is, depending on the vertical stroke length of the valve body 7 in the injector housing 2, the outlet 19 from the control chamber 21 is either closed, partly open, or fully open in the direction of the leaking oil chamber 17.

Upon partial triggering of the actuator 3, the slide region 13 is opened partly, so that a pressure relief of the control chamber can take place via the outlet 19 and the outlet throttle 20 contained in it. Via the outlet 19 of the control chamber 21, which in the partial-stroke state of the valve body 7 communicates with the leaking oil chamber 17 and its outlet 18 via the transverse bore 15 the longitudinal bore 16, a pressure relief of the control chamber 21 is effected. By means of the opening pressure, established at the pressure shoulder 31 and adjusted by the closing spring 27, the piston element 24 moves upward in its hollow chamber, corresponding to the pressure relief of the control chamber 21 in the partial-stroke range of the slide region 13 of the valve body 7.

If the actuator 3 is fully triggered past its partial triggering, then the valve body 7 moves all the way to the top in the injector housing 2 and completely uncovers the inlet; simultaneously, by an overlap of the slide region 13 with the control edge 14 provided on the housing, the pressure relief of the control chamber 21 via its outlet 19 is prevented. By means of the pressure simultaneously rising in the control chamber 21 via the supply line 22, a downward motion of the piston 24 in the injector housing 2 is effected, so that the nozzle needle 23 moves into its seat 29, counter to the upward-oriented force at its pressure shoulder 31, closes the injection port 32.

If the valve body 7 with its seat diameter 8 is brought back into contact with the seat face in the injector housing 2, then the inlet 9 of the high-pressure collection chamber (common rail) is disconnected from the nozzle inlet 12. In the downward motion of the valve body 7, however, the transverse bore 15 inside the slide region 13 and the outlet 19 that discharges at the control edge 14 in the injector housing 2 come to overlap one another in part, so that by way of the outlet 19 and the outlet throttle 20 received in it, a pressure relief in the control chamber 21 can ensue during the closure of the valve body 7. Via the inlet throttle received in the supply line 22 to the control chamber 21, the pressure in the nozzle inlet 12 and thus in the nozzle chamber 28 decreases only gradually, but the pressure in the control chamber 21 decreases faster because of the suitably dimensioned outlet throttle 20. As a result, during the operation of closing the valve body 7, effected by the force exerted vertically on the nozzle needle 23 by the pressure shoulder 31 and counteracting the closing force of the closing spring 27, a re-opening of the nozzle needle 23 out of its seat 29 can be effected, so that a postinjection of fuel can take place without re-triggering the actuator 3 of the injector configured according to the invention.

Thus with the injector 1 configured according to the invention, a graduated opening and closing of the nozzle needle 23, or of the injection port 32 protruding into the combustion chamber of a direct-injection internal combustion engine, can be attained. For performing a main injection 37 or generating a postinjection 38, only a single-time triggering of the actuator 3 of the injector 1, embodied for instance as a magnet valve or piezoelectric actuator, is necessary. The forces to be brought to bear by the actuator 3 in each case become minimal whenever the diameter of the valve body 7, in its guide region inside the injector housing 2, can be embodied with a diameter to correspond with the seat diameter 8. In that case, the valve body 7 of the 3/3-way control valve is force-balanced.

FIG. 2.1 shows the resultant valve stroke 33 in more detail. Reference numerals 34 and 35 indicate the resultant stroke levels. The first stroke level 34 corresponds to the partial stroke of the injector, with partial triggering of the actuator 3, whether it is a piezoelectric actuator or a magnet valve. Reference numeral 35 indicates the second stroke level of the valve body 7, which corresponds to full triggering of the actuator 3.

FIG. 2.2 shows the resultant injection phases in more detail during an injection of fuel into the combustion chamber of a direct-injection internal combustion engine. The pressure course 36 is plotted over time, and reference numeral 37 indicates the maximum pressure that is established during the main injection phase, while reference numeral 38 indicates the pressure level in the postinjection phase, which prevails, depending on the design of the outlet throttle 20 in the outlet line 19 of the control chamber 21, in a gradual relief of the nozzle inlet 12 by way of which the control chamber 21 is subjected to high pressure. The curve course in FIG. 2.3, which represents the pressure course 39 at the seat of the valve body 7, is characterized by a gradually rising flank that then changes into a plateaulike region, because the pressure course 39 is not experiencing any change.

The foregoing relates to preferred exemplary embodiments of the invention, it being understood that other variants and embodiments thereof are possible within the spirit and scope of the invention, the latter being defined by the appended claims.

What is claimed is:

1. An injector for injecting fuel, which is at high pressure, into the combustion chamber of an internal combustion engine, the injector comprising, an injector housing, a valve body (7) which is movable in the injector housing (2) and on which both a slide region (13) and a seat diameter (8), the latter cooperating with a seat face on the housing, are embodied, by way of which said slide region and said seat diameter an inlet (12) to a nozzle chamber (28) of an injection nozzle can be opened and closed, the valve body (7) being embodied as a control valve, by way of whose slide region (13) a control chamber (21) that varies the stroke (33) of a nozzle needle (23) is controlled.

2. The injector according to claim 1, wherein the slide region (13) of the valve body (7) has a transverse bore (15).

3. The injector according to claim 1, wherein the control chamber (21) is relieved on the outlet side via the slide region (13) on the valve body (7) of the 3/3-way control valve.

4. The injector according to claim 1, wherein the control chamber (21) is acted upon via a branch (22) from the nozzle inlet (12).

5. The injector according to claim 4, further comprising an inlet throttle received in the branch (22) from the nozzle inlet (12).

6. The injector according to claim 1, wherein upon triggering of an actuator (3), the valve body (7) opens the nozzle inlet (12), the slide region (13) closes the outlet (19) of the control chamber (21), and high pressure prevails in the control chamber (21).

7. The injector according to claim 6, wherein during the closure of the nozzle needle (23) upon partial overlap of the transverse bore (15) and the outlet (19) between the slide region (13) and the injector housing (2), a pressure relief of the control chamber (21) that enables a postinjection (38) takes place.

8. The injector according to claim 1, wherein upon partial triggering of an actuator (3), the control chamber (21) can be pressure-relieved to the leaking oil (16, 17) via the slide region (13) of the valve body (7).

9. The injector according to claim 8, wherein upon pressure relief of the control chamber (21), the nozzle needle (23) opens independently of the closing force of a closing spring (27).

10. The injector according to claim 1, wherein the valve body (7), in the guide region in the injector housing (2), has a diameter that is identical to its seat diameter (8).

11. An injector for injecting fuel, which is at high pressure, into the combustion chamber of an internal combustion engine, the injector comprising, an injector housing, a valve body (7) which is movable in the injector housing (2) and on which both a slide region (13) and a seat diameter (8), the latter cooperating with a seat face on the housing, are embodied, by way of which said slide region and said seat diameter an inlet (12) to a nozzle chamber (28) of an injection nozzle can be opened and closed, the valve body (7) being embodied as a 3/3-way control valve, by way of whose slide region (13) a control chamber (21) that caries the stroke (33) of a nozzle needle (23) is controlled, wherein the slide region (13) of the valve body (7) has a transverse bore (15), and wherein the transverse bore (15) communicates with a leaking oil chamber (17) via an opening (16).

* * * * *